United States Patent [19]

Bowman et al.

[11] Patent Number: 4,980,120

[45] Date of Patent: Dec. 25, 1990

[54] ARTICULATED SLUDGE LANCE

[75] Inventors: James M. Bowman, New Hamburg; William G. Schneider, Waterloo Co.; Daniel M. St. Louis, Cambridge, all of Canada

[73] Assignee: The Babcock & Wilcox Company, New Orleans, La.

[21] Appl. No.: 450,116

[22] Filed: Dec. 12, 1989

[51] Int. Cl.[5] ..... G21C 19/42

[52] U.S. Cl. ..... 376/316; 376/310; 122/387; 122/392

[58] Field of Search ..... 376/310, 316; 122/387; 127/392

[56] References Cited

U.S. PATENT DOCUMENTS

| | | | |
|---|---|---|---|
| 4,424,769 | 1/1984 | Charamathieu et al. | 122/392 |
| 4,676,201 | 6/1987 | Lahoda et al. | 122/392 |
| 4,715,324 | 12/1987 | Muller et al. | 122/381 |
| 4,757,785 | 7/1988 | Klahn et al. | 122/382 |

*Primary Examiner*—Stephen J. Lechert, Jr.
*Assistant Examiner*—Nina Bhat
*Attorney, Agent, or Firm*—Vytas R. Matas; Robert J. Edwards

[57] ABSTRACT

An articulated lance for cleaning sludge located between steam generator tubes is disclosed. A plurality of radius blocks are attached to the end of manipulator member and are actuatable by a cam assembly to form an arc permitting the lance to be received between adjacent tubes within a tube bundle. A plurality of fluid passageways interconnect a fluid inlet on the manipulator member with one or more outlet orifices adjacent the end of the lance. The outlet orifices are positioned outwardly with respect to the end of the manipulator member so that fluid passing therethrough can be directed to impinge upon sludge surrounding the tubes. A spring backing place biases the radius blocks and the manipulator member back into the same plane upon deactuation of the cam assembly.

11 Claims, 2 Drawing Sheets

ARTICULATED SLUDGE LANCE

TECHNICAL FIELD

The present invention relates, in general, to equipment for cleaning steam generators and, in particular, to an articulated fluid lance for cleaning sludge from the lower portions of steam generator tubes.

BACKGROUND ART

In nuclear power stations, steam generators, such as recirculating steam generators and once-through steam generators, are used for heat exchange purposes in the generation of steam to drive the turbines. Primary fluid which is heated by the core of the nuclear reactor passes through a bundle of tubes in the steam generator. Secondary fluid, generally water, which is fed into the space surrounding the tubes receives heat from the tubes and is converted into steam for driving the turbines. After cooling and condensation has occurred, the secondary fluid is directed back into the space around the tubes to provide a continuous steam generation cycle. Due to the constant high temperature and severe operating conditions, sludge accumulates on the lower portions of the tubes and on the tubesheet which supports same. The sludge which is mainly comprised of an iron oxide, such as magnetite, reduces the heat transfer efficiency of the tubes and can cause corrosion. Thus, the tubes must be cleaned periodically to remove the sludge and various types of apparatus and methods are available to accomplish this task.

U.S. Pat. No. 4,566,406 entitled "Sludge Removing Apparatus for a Steam Generator" discloses a manifold which is rigidly attached to the tubesheet and remains in place during conventional operation of the steam generator. A plurality of nozzles on the manifold emits streams of water to break up sludge on the upper surface of the tubesheet. Openings are provided in the walls of the steam generator to remove the slurry.

U.S. Pat. No. 4,079,701 entitled "Steam Generator Sludge Removal System" discloses an arrangement of headers at the elevation of the sludge to be removed from around the tubes in order to establish a circumferential fluid stream at that elevation. A fluid lance moved along a line between the headers emits a fluid jet perpendicular to the line of movement of the fluid lance. The lance may also be rotated as it is moved.

U.S. Pat. No. 4,700,662 entitled "Sludge Lance Wand" discloses a lance for cleaning once-through steam generator tubes. The lance has a fixed radius of curvature thus necessitating manual manipulation of same in order to insert the lance between tubes within the tube bundle in the steam generator.

All of the foregoing apparatus have some inherent disadvantages which prevent them from efficiently removing the sludge which accumulates around the tubes within the tube bundle. Because of this, it has become desirable to develop a sludge lance which can be manipulated so as to easily pass through the openings between adjacent tubes within the tube bundle.

SUMMARY OF THE INVENTION

The present invention solves the problems associated with the prior art and other problems by providing a sludge lance having an adjustable articulated portion permitting easy insertion of the lance between the tubes within a tube bundle in a steam generator. The lance includes a manipulator member whose outer end is attached to a plurality of radius blocks arranged in an abutting relationship. The radius blocks are movable through the actuation of a cam assembly causing the radius blocks to form an arc having an adjustable radius of curvature. A fluid distribution member having a split manifold at its outer end is affixed to the manipulator member and the radius blocks and positioned so that the split manifold is positioned outwardly from the end of the radius block assembly. A spring backing plate is attached to the manipulator member and the radius blocks so as to cover a portion of the fluid distribution member, and is used to bias the manipulator member and the radius blocks into the same plane upon deactuation of the cam assembly. A plurality of orifices in the split manifold located at the end of the fluid distribution member permit the passage of fluid therethrough for impingement upon the sludge between the tubes within the tube bundle to dissolve same.

DESCRIPTION OF THE PREFERRED EMBODIMENT

Figure 1:
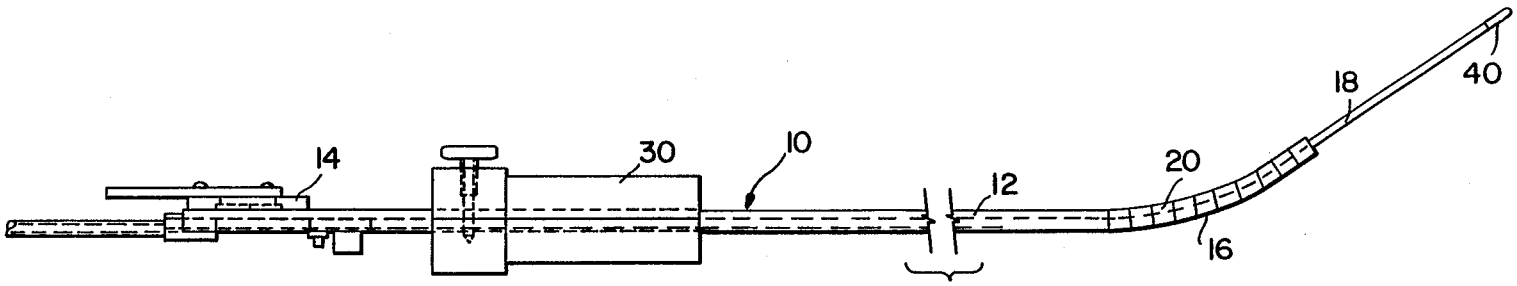
FIG. 1 is a front elevational view of the articulated sludge lance of the present invention.

Referring now to the drawings where the illustrations are for the purpose of describing the preferred embodiment of the present invention and are not intended to limit the invention described herein, FIG. 1 is a front elevational view of the articulated sludge lance 10 of the present invention. The sludge lance 10 is comprised of a manipulator member 12, a cam assembly 14 attached to one end of the manipulator member 12, a spring backing plate 16 attached to the underside of the manipulator member 12 adjacent the opposite end thereof, and a water distribution member 18 positioned so that a portion thereof is interposed between the bottom surface of the manipulator member 12 and the top surface of the spring backing plate 16.

Figure 2:
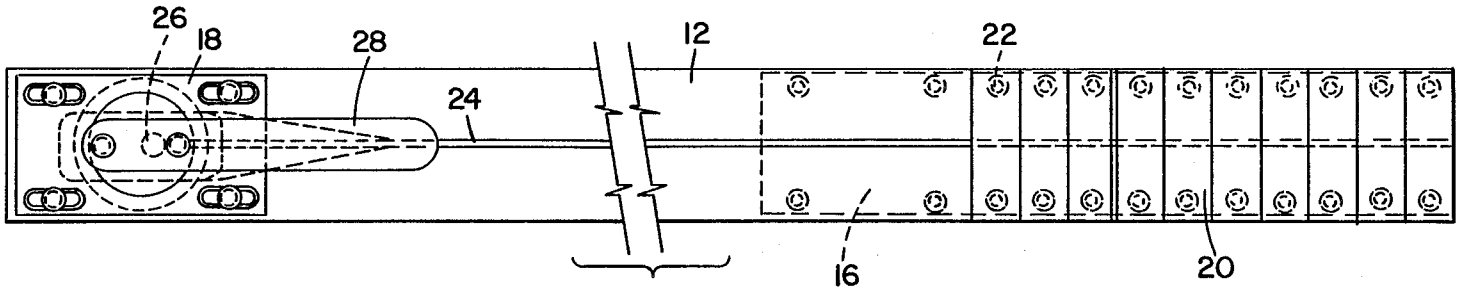
FIG. 2 is a top plan view of the articulated sludge lance shown in FIG. 1.
Figure 3:
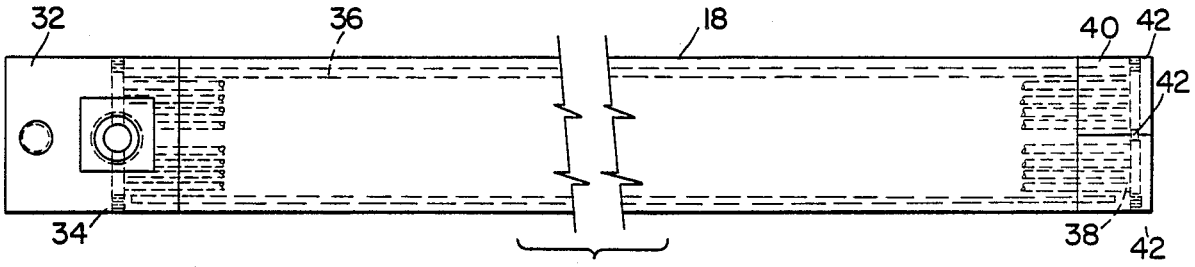
FIG. 3 is a top plan view of the fluid distribution member utilized by the articulated sludge lance of the present invention.

The manipulator member 12 is formed from a high impact strength plastic, is elongated and typically has a substantially rectangular cross-section. As previously stated, the cam assembly 14 is attached to one end of the manipulator member 12. A plurality of radius blocks 20, each having a substantially rectangular cross-section of approximately the same size as the manipulator member 12, is attached to the opposite end of the manipulator member 12 so as to be aligned therewith. Attachment is effected by means of the spring backing plate 16 which is attached to the bottom of the manipulator member 12 and to the bottom of each of the radius blocks 20 by fasteners 22. The radius blocks 20 are positioned in an abutting relationship to one another and to the end of the manipulator member 12. As shown in FIG. 2, a wire cable 24 traverses through the length of the manipulator member 12 and through each of the radius blocks 20. One end of the cable 24 is connected to the outer most radius block 20 and the other end of the cable 24 is connected to a pin 26 (shown in phantom) within the cam assembly 14. A cam lever 28 is attached to the cam assembly 14 permitting rotation thereof. Rotation of the cam lever 28 in the clockwise direction causes the wire cable 24 to move to the left causing the radius blocks to be drawn into an arc with respect to the manipulator member 12, as illustrated in FIG. 1. Subsequent rotation of the cam lever 28 back to its original position causes the wire cable 24 to move to the right resulting in the radius blocks 20 returning to their original position so as to be in the same plane as manipulator member 12. The spring backing plate 16 urges the radius blocks 20 to return to their original position.

The water distribution member 18 is elongated and has a substantially rectangular cross-section which is similar to, but smaller, than the rectangular cross-section of the manipulator member 12 and the radius blocks 20. The water distribution member 18 is received within a recess provided in the bottom of the manipulator member 12 and is attached thereto by a mounting block 30. The water distribution member 18 is similarly received within a recess provided within the bottom of each radius block 20 so as to be interposed between the sprig backing plate 16 and the radius blocks 20. The length of the water distribution member 18 is greater than the combined length of the manipulator member 12 and the radius blocks 20 attached thereto causing the outer end of the water distribution member 18 to be exposed. The rear manifold portion 32 of the water distribution member 18 includes a water inlet 34 which communicates with a plurality of longitudinally extending spaced apart water tubes 36 within the water distribution member 18. Approximately 8 water tubes having an outside diameter of 0.084 inches and a wall thickness of 0.008 inches are provided. The water tubes 36 terminate in a transverse passageway 38 located in a split manifold 40 at the outer end of the water distribution member 18. The split manifold 40 is positioned so as to be located adjacent the outermost radius block 20. Each of the ends of the transverse passageway 38 and the center thereof is provided with an outlet orifice 42. Each outlet orifice 42 is provided with a sapphire jewel therein to minimize wear thereof.

Figure 4:
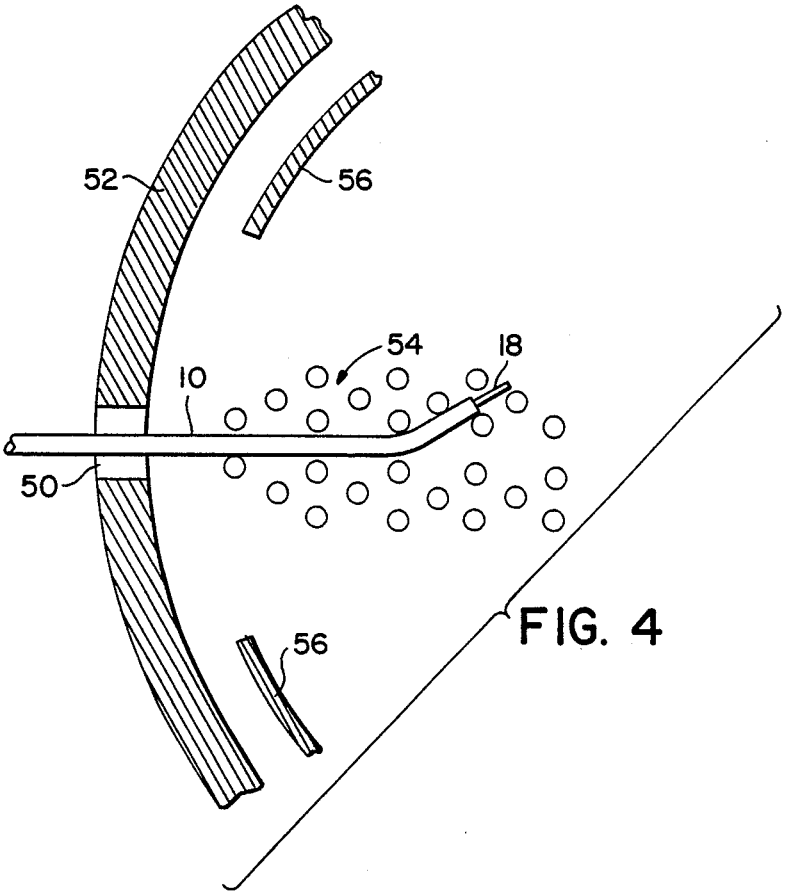
FIG. 4 is a top plan view of the articulated sludge lance of the present invention in use in a steam generator.

Referring now to FIG. 4, in operation, the sludge lance 10 is inserted through a handhole 50 provided in a steam generator shell 52 and into a lane or space between tubes in a tube bundle 54. As shown, a space provided in shroud 56 surrounding the tube bundle 54 allows easy access thereto. The manipulator member 12 is supported by the lower tubesheet and fluid pressure is supplied to the lance from a fluid source (not shown). By rotation of the cam lever 28, the angular deflection of the radius blocks 20 can be adjusted permitting the sludge lance 10 to enter between tubes within the tube bundle 54. As the sludge lance 10 is moved through the tube bundle 54, fluid flow from the outlet orifices 42 in the water distribution member 18 loosens and removes sludge from the tubes which is then removed from the generator by a suction system. The fluid/sludge mixture is filtered to remove the solids and the fluid is recirculated. Manipulation of the sludge lance 10 by rotation of the cam lever 28 during operation permits entry of the lance 10 between the tubes within the tube bundle 54 and the foregoing manipulation can be done manually or remotely while being monitored by a video system.

Certain modifications and improvements will occur to those skilled in the art upon reading the foregoing. It should be understood that all such modifications and improvements have been deleted herein for the sake of conciseness and readability, but are properly within the scope of the following claims.

We claim:

1. A lance for assisting in the removal of sludge located between a plurality of tubes within a steam generator comprising a manipulator member, a plurality of block members attached to said manipulator member, a fluid distribution member having at least one orifice therein, said fluid distribution member being attached to said manipulator member so that said at least one orifice is positioned outwardly from the end of said manipulator member, and means causing said plurality of block members to form an arc permitting the lance to be received between the tubes.

2. The lance as defined in claim 1 wherein said plurality of block members is attached to an end of said manipulator member.

3. The lance as defined in claim 1 wherein said plurality of block members are positioned in an abutting relationship relative to one another.

4. The lance as defined in claim 1 further including a cam assembly attached to said manipulator member so as to be substantially oppositely disposed to said at least one orifice in said fluid distribution member, said cam assembly including actuating means causing said plurality of block members to form an arc upon actuation thereof.

5. The lance as defined in claim 4 wherein said cam assembly includes lever means and means for connecting said cam assembly with said plurality of block members.

6. The lance as defined in claim 5 wherein actuation of said lever means causes said connecting means to move relative to said manipulator member and said plurality of block members causing said plurality of block members to form an arc.

7. The lance as defined in claim 5 further including biasing means attached to said manipulator members and said plurality of block members, said biasing means urging said plurality of block members and said manipulator member into the same plane upon the deactuation of said lever means.

8. The lance as defined in claim 1 wherein said fluid distribution member includes a plurality of passageways positioned substantially parallel to one another along the longitudinal axis of said fluid distribution member.

9. The lance as defined in claim 8 further including fluid inlet means in said fluid distribution member, said fluid inlet means being in fluidic communication with said plurality of passageways and being substantially oppositely disposed to said at least one orifice in said fluid distribution member.

10. The lance as defined in claim 8 further including manifold means having at least one passageway in fluidic communication with said plurality of passageways in said fluidic distribution member, said at least one orifice being positioned within the end of said at least one passageway.

11. The lance as defined in claim 1 further including jewel means received within said at least one orifice in said fluid distribution member.

* * * * *